US011376836B2

(12) United States Patent
Billiet et al.

(10) Patent No.: US 11,376,836 B2
(45) Date of Patent: Jul. 5, 2022

(54) LITHOGRAPHIC PRINTING PLATE PRECURSOR

(71) Applicant: AGFA NV, Mortsel (BE)

(72) Inventors: Thomas Billiet, Mortsel (BE); Tim Desmet, Mortsel (BE); Jos Louwet, Mortsel (BE); Kristof Heylen, Mortsel (BE)

(73) Assignee: AGFA NV, Mortsei (BE)

( * ) Notice: Subject to any disclaimer, the term of this patent is extended or adjusted under 35 U.S.C. 154(b) by 332 days.

(21) Appl. No.: 16/636,042

(22) PCT Filed: Jul. 12, 2018

(86) PCT No.: PCT/EP2018/068971
§ 371 (c)(1),
(2) Date: Feb. 3, 2020

(87) PCT Pub. No.: WO2019/029945
PCT Pub. Date: Feb. 14, 2019

(65) Prior Publication Data

US 2021/0354439 A1 Nov. 18, 2021

(30) Foreign Application Priority Data

Aug. 7, 2017 (EP) ..... 17185082

(51) Int. Cl.
*B41C 1/10* (2006.01)
*B41N 1/14* (2006.01)
*B41M 1/06* (2006.01)

(52) U.S. Cl.
CPC ..... *B41C 1/1016* (2013.01); *B41M 1/06* (2013.01); *B41N 1/14* (2013.01); *B41C 2201/02* (2013.01); *B41C 2201/14* (2013.01); *B41C 2210/04* (2013.01); *B41C 2210/08* (2013.01); *B41C 2210/24* (2013.01)

(58) Field of Classification Search
None
See application file for complete search history.

(56) References Cited

U.S. PATENT DOCUMENTS

| | | | |
|---|---|---|---|
| 2003/0005838 | A1 | 1/2003 | Damme et al. |
| 2003/0162127 | A1 | 8/2003 | Kikuchi |
| 2007/0043205 | A1 | 2/2007 | Dias et al. |
| 2017/0047142 | A1 | 2/2017 | Disson et al. |

FOREIGN PATENT DOCUMENTS

| | | | |
|---|---|---|---|
| CN | 1608861 | A | 4/2005 |
| EP | 0 770 494 | A2 | 5/1997 |
| EP | 0 770 495 | A1 | 5/1997 |
| EP | 0 770 496 | A1 | 5/1997 |
| EP | 0 770 497 | A1 | 5/1997 |
| EP | 1 342 568 | A1 | 9/2003 |
| EP | 1 518 672 | A2 | 3/2005 |
| EP | 1 614 538 | A2 | 1/2006 |
| EP | 1 614 539 | A1 | 1/2006 |
| EP | 1 614 540 | A1 | 1/2006 |
| EP | 1 974 911 | A1 | 10/2008 |
| EP | 2 177 357 | B1 | 10/2014 |
| JP | H07114175 | A | 5/1995 |
| JP | 2009227900 | A | 10/2009 |
| JP | 2015030122 | A | 2/2015 |
| WO | 2016/097169 | A1 | 6/2016 |

OTHER PUBLICATIONS

Office Action relating to Indian Patent Application No. 202017004845 dated Mar. 4, 2021, 6 pages.
Office Action relating to Chinese Patent Application No. 201880051490.4 dated Dec. 23, 2020 (including English translation of Office Action), 20 pages.
Official Communication issued in International Patent Application No. PCT/EP2018/068971, dated Sep. 19, 2018.

*Primary Examiner* — Joshua D Zimmerman
(74) *Attorney, Agent, or Firm* — Leydig, Voit & Mayer, Ltd.

(57) ABSTRACT

A negative-working lithographic printing plate precursor includes a coating including vinylogous vitrimer particles. The vinylogous vitrimer particles include a resin having at least one moiety of formula (I), (II), and/or (III):

(I)

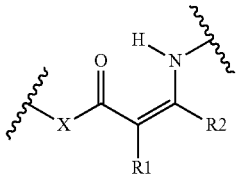

(II)

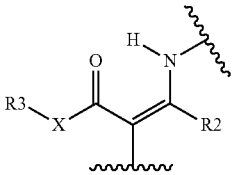

(III)

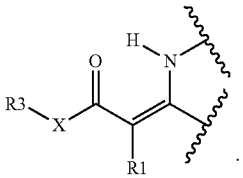

14 Claims, No Drawings

LITHOGRAPHIC PRINTING PLATE PRECURSOR

CROSS REFERENCE TO RELATED APPLICATIONS

This application is a 371 National Stage Application of PCT/EP2018/068971, filed Jul. 12, 2018. This application claims the benefit of European Application No. 17185082.9, filed Aug. 7, 2017, which is incorporated by reference herein in its entirety.

BACKGROUND OF THE INVENTION

1. Field of the Invention

The invention relates to a novel lithographic printing plate precursor.

2. Description of the Related Art

Lithographic printing typically involves the use of a so-called printing master such as a printing plate which is mounted on a cylinder of a rotary printing press. The master carries a lithographic image on its surface and a print is obtained by applying ink to said image and then transferring the ink from the master onto a receiver material, which is typically paper. In conventional lithographic printing, ink as well as an aqueous fountain solution (also called dampening liquid) are supplied to the lithographic image which consists of oleophilic (or hydrophobic, i.e. ink-accepting, water-repelling) areas as well as hydrophilic (or oleophobic, i.e. water-accepting, ink-repelling) areas. In so-called driographic printing, the lithographic image consists of ink-accepting and ink-abhesive (ink-repelling) areas and during driographic printing, only ink is supplied to the master.

Lithographic printing masters are generally obtained by the image-wise exposure and processing of a radiation sensitive layer on a lithographic support. Imaging and processing renders the so-called lithographic printing plate precursor into a printing plate or master. Image-wise exposure of the radiation sensitive coating to heat or light, typically by means of a digitally modulated exposure device such as a laser, triggers a (physico-)chemical process, such as ablation, polymerization, insolubilization by cross-linking of a polymer or by particle coagulation of a thermoplastic polymer latex, solubilization by the destruction of intermolecular interactions or by increasing the penetrability of a development barrier layer. Although some plate precursors are capable of producing a lithographic image immediately after exposure, the most popular lithographic plate precursors require wet processing since the exposure produces a difference in solubility or difference in rate of dissolution in a developer between the exposed and the non-exposed areas of the coating. In positive working lithographic plate precursors, the exposed areas of the coating dissolve in the developer while the non-exposed areas remain resistant to the developer. In negative working lithographic plate precursors, the non-exposed areas of the coating dissolve in the developer while the exposed areas remain resistant to the developer. Most lithographic plate precursors contain a hydrophobic coating on a hydrophilic support, so that the areas which remain resistant to the developer define the ink-accepting, hence printing areas of the plate while the hydrophilic support is revealed by the dissolution of the coating in the developer at the non-printing areas.

Photopolymer printing plates rely on a working-mechanism whereby the coating—which typically includes free radically polymerisable compounds—hardens upon exposure. "Hardens" means that the coating becomes insoluble or non-dispersible in the developing solution and may be achieved through polymerization and/or crosslinking of the photosensitive coating upon exposure to light. Photopolymer plate precursors can be sensitized to blue, green or red light i.e. wavelengths ranging between 450 and 750 nm, to violet light i.e. wavelengths ranging between 350 and 450 nm or to infrared light i.e. wavelengths ranging between 750 and 1500 nm. Optionally, the exposure step is followed by a heating step to enhance or to speed-up the polymerization and/or crosslinking reaction.

Negative working plate precursors which do not require a pre-heat step may contain an image-recording layer that works by heat-induced particle coalescence of a thermoplastic polymer latex, as described in e.g. EP 770 494, EP 770 495, EP 770 496 and EP 770 497. These patents disclose a method for making a lithographic printing plate comprising the steps of (1) image-wise exposing to infrared light an imaging element comprising thermoplastic polymer particles, sometimes also referred to as latex particles, dispersed in a hydrophilic binder and a compound capable of converting light into heat and (2) developing the image-wise exposed element by applying fountain and/or ink. During the development step, the unexposed areas of the image-recording layer are removed from the support, whereas the latex particles in the exposed areas have coalesced to form a hydrophobic phase which is not removed in the development step. In EP 1 342 568 a similar plate precursor is developed with a gum solution and in EP 1 614 538, EP 1 614 539 and EP 1 614 540 development is achieved by means of an alkaline solution.

A problem associated with plate precursors that work according to the mechanism of heat-induced latex coalescence is that it is difficult to obtain both a high sensitivity enabling exposure at a low energy density, and a good clean-out of the unexposed areas during development—i.e. the complete removal of the non-exposed areas during the development step. The energy density that is required to obtain a sufficient degree of latex coalescence and of adherence of the exposed areas to the support is often higher than 250 mJ/cm$^2$. As a result, in platesetters that are equipped with low power exposure devices such as semiconductor infrared laser diodes, such materials require long exposure times. Also, when a low power exposure device is used, the extent of coalescence is often low and the exposed areas may degrade rapidly during the press run and as a result, a low press life is obtained.

In the graphic arts industry, there is an evolution towards the use of recycled paper and more abrasive inks, fountain solutions and/or plate cleaners. These harsh printing conditions not only impose more stringent demands on the chemical resistance of the printing plates towards pressroom chemicals and inks, but also reduce the press life of the plate. In addition, printing plates are susceptible to damage caused by mechanical forces applied to the surface of the coating during for example automatic transport, mechanical handling, manual handling and/or printing. Mechanical damage may result in a reduced printing quality due to destruction of the surface of the coating of the printing plate and/or also to a reduced press life. To improve the chemical resistance, the press life and/or the robustness of for example printing plates often a heat-treatment is carried out after the exposure and/or development steps. Other solutions to these issues have been provided in the art by optimizing the coatings for example by selection of specific resins—e.g. by chemical modification—and/or by providing double layer coatings.

In conclusion, despite the solutions provided in the art, there is still an urgent need for printing plates which are characterized by an improved durability and press life, preferably obtained by gum processing or on-press processing.

WO2016/097169 discloses polymeric networks which combine great mechanical properties and a suitable glass transition temperature with the ability to be reshaped at elevated temperatures such as vinylogous-urethane, vinylogous-amide or vinylogous urea. These materials are prepared by bulk polymerisation leading to a paste and does not lead to aqueous dispersions without grinding and dispersing the obtained particles in aqueous medium.

Sanchez et al. disclose in Chem. Commun. 2014, 50, 1871 vinylogous urethanes as exchangeable and reversible links in single chain polymer particles.

SUMMARY OF THE INVENTION

It is an object of the present invention to provide a negative-working lithographic printing plate precursor which provides a printing plate with excellent lithographic properties in terms of both sensitivity and press life.

This object is realized by the printing plate precursor defined below with preferred embodiments also defined below. The invention has the specific feature that the printing plate material includes a coating comprising vinylogous vitrimer particles.

It has surprisingly been observed that upon exposure to heat and/or light, of a printing plate material including a coating comprising vinylogous vitrimer particles results, even at low exposure energies such as for example below 190 mJ/m$^2$, in printing plates with an excellent sensitivity and an excellent press life.

Other features, elements, steps, characteristics and advantages of the present invention will become more apparent from the following detailed description of preferred embodiments of the present invention. Specific embodiments of the invention are also defined in the dependent claims.

DETAILED DESCRIPTION OF THE PREFERRED EMBODIMENTS

The lithographic printing plate precursor of the current invention comprises, provided on a support, a coating including vinylogous vitrimer particles. Vitrimers are a class of polymers which consist of covalent networks which at high temperatures can flow like viscoelastic liquids and at low temperatures behave like thermosets. As a result, vitrimers are new polymeric materials that comprise thermally malleable network properties while permanent connectivity is displayed at all temperatures; at higher temperatures the viscosity is governed by chemical exchange reactions, leading to a thermal viscosity decrease that follows Arrhenius law, also referred to as having "covalent adaptable networks". The prevalence of so-called dynamic crosslinks can re-arrange upon external stimuli, whereby, the material displays both thermoplastic and thermosetting behaviour. The temperature at which these crosslink exchange reactions occur is also referred to as "the topology freezing transition temperature, $T_v$" by Leibler et al. (M. Capelot, D. Montarnal, F. Tournilhac and L. Leibler, J. am. Chem. Soc., 2012 134, 7664-7667). The term "vinylogous" refers to a structural moiety in which the standard moiety of a functional group is separated by a conjugated bonded system, for example, a carbon-carbon double bond (>C═C<).

The vinylogous vitrimer particle present in the coating of the printing plate precursor of the current invention preferably includes a resin selected from vinylogous-urethane, vinylogous-amide or vinylogous-urea units or a combination thereof. Vinylogous urethanes are compounds containing the chemical functionality —N—C═C—C(═O)—O—; vinylogous urea are compounds containing the chemical functionality —N—C═C—C(═O)—NR— and vinylogous amide are compounds containing the chemical functionality —N—C═C—C(═O)—CRR'—. In a highly preferred embodiment, the vinylogous vitrimer particle present in the coating of the present invention includes a vinylogous-urethane.

The vinylogous vitrimer particles preferably comprise a resin having at least one moiety of formula (I), (II), and/or (III):

Formula (I)

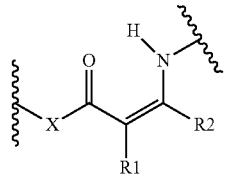

Formula (II)

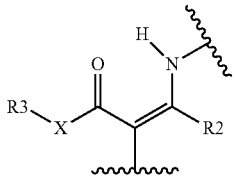

Formula (III)

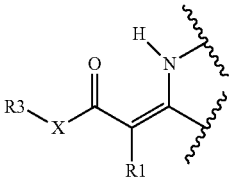

wherein

R1 represents hydrogen, an optionally substituted alkyl, cycloalkyl, alkenyl, cycloalkenyl, alkynyl, aralkyl, alkaryl, aryl or heteroaryl group, COR4 or CN;

R2 represents hydrogen, an optionally substituted alkyl, cycloalkyl, alkenyl, cycloalkenyl, alkynyl, aralkyl, alkaryl, aryl or heteroaryl group, COR4;

R1 and R2 may represent the necessary atoms to form a five to eight membered ring;

R3 represents an optionally substituted alkyl, cycloalkyl, alkenyl, cycloalkenyl, alkynyl, aralkyl, alkaryl, aryl or heteroaryl group;

R4 represents hydrogen, an optionally substituted alkyl, cycloalkyl, alkenyl, cycloalkenyl, alkynyl, aralkyl, alkaryl, aryl or heteroaryl group, OR5 or NR6R7;

R5 represents an optionally substituted alkyl, cycloalkyl, alkenyl, cycloalkenyl, alkynyl, aralkyl, alkaryl, aryl or heteroaryl group;

R6 and R7 independently represent hydrogen, an optionally substituted alkyl, cycloalkyl, alkenyl, cycloalkenyl, alkynyl, aralkyl, alkaryl, aryl or heteroaryl group, or R6 and R7 may represent the necessary atoms to form a five to eight membered ring;

X represents O, NR8 or CR9R10;

R8, R9 and R10 independently represent hydrogen, an optionally substituted alkyl, cycloalkyl, alkenyl, cycloalkenyl, alkynyl, aralkyl, alkaryl, aryl or heteroaryl group;

R8 and R3 may represent the necessary atoms to form a five to eight membered ring;

any of R3, R9 and R10 may represent the necessary atoms to form a five to eight membered ring.

The vinylogous vitrimer particles preferably comprise a resin having at least two moieties of formula (I), (II), and/or (III); more preferably at least three moieties of formula (I), (II), and/or (III) and most preferably more than three moieties of formula (I), (II), and/or (III).

In a preferred embodiment, the vinylogous vitrimer particles comprise a resin including at least one moiety according to formula I. In a further preferred embodiment, X represents O. In a further preferred embodiment R1 represents hydrogen, an optionally substituted alkyl or aryl group, hydrogen being particularly preferred. In another preferred embodiment, R2 represents an optionally substituted alkyl group or aryl group. In the most preferred embodiment R2 represents a C1 to C6 alkyl group, a methyl group being the most preferred.

Examples of suitable aryl groups may be represented by for example an optionally substituted phenyl, benzyl, tolyl or an ortho-meta- or para-xylyl group, an optionally substituted naphtyl, anthracenyl, phenanthrenyl, and/or combinations thereof. The heteroaryl group is preferably a monocyclic or polycyclic aromatic ring comprising carbon atoms and one or more heteroatoms in the ring structure, preferably, 1 to 4 heteroatoms, independently selected from nitrogen, oxygen, selenium and sulphur. Preferred examples thereof include an optionally substituted furyl, pyridinyl, pyrimidyl, pyrazoyl, imidazoyl, oxazoyl, isoxazoyl, thienyl, tetrazoyl, thiazoyl, (1,2,3)triazoyl, (1,2,4)triazoyl, thiadiazoyl, thiofenyl group and/or combinations thereof.

Examples of suitable alkyl groups are methyl, ethyl, n-propyl, isopropyl, n-butyl, 1-isobutyl, 2-isobutyl and tertiary-butyl, n-pentyl, n-hexyl, chloromethyl, trichloromethyl, iso-propyl, iso-butyl, iso-pentyl, neo-pentyl, 1-methylbutyl and iso-hexyl, 1,1-dimethyl-propyl, 2,2-dimethylpropyl and 2-methyl-butyl, cyclopropyl, cyclobutyl, cyclopentyl, cyclohexyl and methylcyclohexyl groups. n-butyl, etc.

A suitable alkenyl group is preferably a $C_2$ to $C_6$-alkenyl group such as an ethenyl, n-propenyl, n-butenyl, n-pentenyl, n-hexenyl, iso-propenyl, iso-butenyl, iso-pentenyl, neo-pentenyl, 1-methylbutenyl, iso-hexenyl, cyclopentenyl, cyclohexenyl and methylcyclohexenyl group.

A suitable alkynyl group is preferably a $C_2$ to $C_6$-alkynyl group; a suitable aralkyl group is preferably a phenyl group or naphthyl group including one, two, three or more $C_1$ to $C_6$-alkyl groups; a suitable alkaryl group is preferably a $C_1$ to $C_6$-alkyl group including an aryl group, preferably a phenyl group or naphthyl group.

A cyclic group or cyclic structure includes at least one ring structure and may be a monocyclic- or polycyclic group, meaning one or more rings fused together.

The term "substituted", in e.g. substituted alkyl group means that the alkyl group may be substituted by other atoms than the atoms normally present in such a group, i.e. carbon and hydrogen. For example, a substituted alkyl group may include a halogen atom or a thiol group. An unsubstituted alkyl group contains only carbon and hydrogen atoms.

The optional substituents on the alkyl, cycloalkyl, alkenyl, cycloalkenyl, alkynyl, aralkyl, alkaryl, aryl and heteroaryl group are preferably selected from hydroxy, —Cl, —Br, —I, —OH, —SH, —CN, —$NO_2$, an alkyl group such as a methyl or ethyl group, an alkoxy group such as a methoxy or an ethoxy group, an aryloxy group, a carboxylic acid group or an alkyl ester thereof, a sulphonic acid group or an alkyl ester thereof, a phosphonic acid group or an alkyl ester thereof, a phosphoric acid group or an ester such as an alkyl ester such as methyl ester or ethyl ester, a thioalkyl group, a thioaryl group, thioheteroaryl, —SH, a thioether such as a thioalkyl or thioaryl, ketone, aldehyde, sulfoxide, sulfone, sulfonate ester, sulphonamide, an amino, ethenyl, alkenyl, alkynyl, cycloalkyl, alkaryl, aralkyl, aryl, heteroaryl or heteroalicyclic group and/or combinations thereof.

The vinylogous vitrimer particles preferably have a core-shell structure, i.e. a shell surrounding a core, wherein the shell preferably comprises the resin as discussed above. Such core-shell structures can be prepared by the reaction of a bis-acetoacetate monomer and a diamine, triamine and/or a polyamine. More details for the preparation of such structures are described in unpublished patent application EP-A 17177418, filed on 22 Jun. 2017 in [0021] to [0042] and are incorporated herein by reference.

The coating may comprise one or more layer(s) and the layer comprising the vinylogous vitrimer particles is referred to herein as the 'image-recording layer'. The image-recording layer preferably includes the vinylogous vitrimer particles in the form of core/shell particles. The weight average molecular weight of the vinylogous vitrimer particles may range from 5,000 to 1,000,000 g/mol. The vinylogous vitrimer particles preferably have a number average particle diameter below 500 nm, more preferably between 10 and 350 nm. In a specific embodiment, the average particle size is comprised between 40 nm and 100 nm, more preferably between 50 nm and 90 nm. The particle size is defined herein as the particle diameter, measured by Photon Correlation Spectrometry, also known as Quasi-Elastic or Dynamic Light-Scattering. This technique produces values of the particle size that match well with the particle size measured with transmission electronic microscopy (TEM) as disclosed by Stanley D. Duke et al. in Calibration of Spherical Particles by Light Scattering, in Technical Note-002B, May 15, 2000 (revised 1/3/2000 from a paper published in Particulate Science and Technology 7, p. 223-228 (1989). An optimal ratio between the pore diameter of the hydrophilic surface of the aluminum support (if present) and the average particle size of the vinylogous vitrimer particles may enhance the press life of the plate and may improve the toning behaviour of the prints. The ratio of the average pore diameter of the hydrophilic surface of the aluminum support to the average particle size of the vinylogous vitrimer particles preferably ranges from 0.05:1 to 0.8:1, more preferably from 0.10:1 to 0.35:1.

The vinylogous vitrimer particles present in the image-recording layer can be applied onto the lithographic base in the form of a dispersion in an aqueous coating liquid and may be prepared by the methods disclosed in the unpublished patent application EP-A 17177418, filed on 22 Jun. 2017.

The amount of vinylogous vitrimer particles contained in the image-recording layer is preferably between 10 and 90 percent by weight (wt %), relative to the weight of all the components in the image-recording layer. In a preferred embodiment, the amount of vinylogous vitrimer particles present in the image-recording layer is at least 70 wt %, more preferably at least 75 wt %. An amount between 75 wt % and 85 wt % produces excellent results.

The Infrared Absorbing Compound

The coating preferably includes, besides the vinylogous vitrimer particles, an infrared absorbing compound. The IR absorbing compound may be an infrared light absorbing dye or pigment. An infrared light absorbing dye is preferred, also referred to herein as IR-dye. The infrared light absorbing dye preferably has an absorption spectrum between 750 nm and 1300 nm, preferably between 780 nm and 1200 nm, more preferably between 800 nm and 1100 nm. The IR absorbing compound absorbs infrared light and converts the absorbed energy into heat.

The concentration of the IR-dyes with respect to the total dry weight of the coating, is preferably from 0.25 wt % to 25.0 wt %, more preferably from 0.5 wt % to 20.0 wt %, most preferred from 1.0 wt % to 10.0 wt %.

The infrared absorbing compound can be present in the image-recording layer and/or in an optional other layer. In the embodiment where the vinylogous vitrimer particles have a core-shell structure, the IR-dye is preferably present in the core of the vinylogous vitrimer particles. The preparation of such vinylogous vitrimer particles is disclosed in the unpublished co-pending application EP-A 1717 7418.

Preferred IR absorbing compounds are dyes such as cyanine, merocyanine, indoaniline, oxonol, pyrilium and squarilium dyes or pigments such as carbon black. Examples of suitable IR absorbers are described in e.g. EP 823 327, EP 978 376, EP 1 029 667, EP 1 053 868, EP 1 093 934; WO 97/39894 and WO 00/29214. Particular preferred dyes are heptamethinecyane dyes, especially the dyes disclosed in EP 1 359 008 paragraph to [0032].

The infrared absorbing agent is preferably represented by Formula A:

(Formual A)

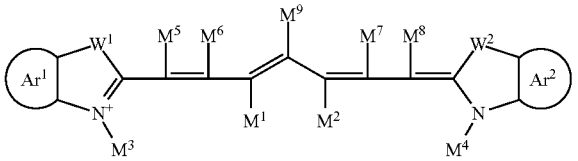

wherein $Ar^1$ and $Ar^2$ are independently an optionally substituted aromatic hydrocarbon group or an aromatic hydrocarbon group with an annulated benzene ring which is optionally substituted, $W^4$ and $W^2$ are independently a sulphur atom or a —$CM^{10}M^{11}$ group wherein $M^{11}$ and $M^{11}$ are independently an optionally substituted aliphatic hydrocarbon group or an optionally substituted (hetero)aryl group, or wherein $M^{10}$ and $M^{11}$ together comprise the necessary atoms to form a cyclic structure, $M^4$ and $M^2$ together comprise the necessary atoms to form an optionally substituted cyclic structure, preferably $M^1$ and $M^2$ together comprise the necessary atoms to form an optionally substituted 5-membered ring, $M^3$ and $M^4$ independently represent an optionally substituted aliphatic hydrocarbon group, $M^5$, $M^6$, $M^7$ and $M^8$ independently represent hydrogen, a halogen or an optionally substituted aliphatic hydrocarbon group, $M^9$ represents a halogen, an optionally substituted aliphatic hydrocarbon group, an optionally substituted (hetero) aryl group, —$NR'R^2$, —NR'—CO—$R^6$, —NR'—$SO_2$—$R^4$ or —NR'—SO—$R^5$; wherein R' and $R^2$ independently represent hydrogen, an optionally substituted aliphatic hydrocarbon group or an optionally substituted (hetero)aryl group;

$R^4$ and $R^6$ independently represent —$OR^7$, —$NR^8R^9$ or —$CF_3$; wherein $R^7$ represents an optionally substituted (hetero)aryl group or an optionally branched aliphatic hydrocarbon group and $R^8$ and $R^9$ independently represent hydrogen, an optionally substituted aliphatic hydrocarbon group or an optionally substituted (hetero) aryl group, or wherein $R^8$ and $R^9$ together comprise the necessary atoms to form a cyclic structure;

$R^5$ represents hydrogen, an optionally substituted aliphatic hydrocarbon group, $SO_3^-$, —$COOR^{10}$ or an optionally substituted (hetero)aryl group; wherein $R^{10}$ represents an optionally substituted (hetero)aryl group or an aliphatic hydrocarbon group; and the infrared absorbing agent may include one or more counter ions in order to obtain an electrically neutral molecule.

An aliphatic hydrocarbon group preferably represents an alkyl, cycloalkyl, alkenyl, cyclo alkenyl or alkynyl group; suitable groups thereof are described above. Suitable hetero (aryl) groups—i.e. suitable aryl or heteroaryl groups—are described above.

Suitable examples of optional substituents are described above.

The IR dye can be a neutral, an anionic or a cationic dye depending on the type of the substituting groups and the number of each of the substituting groups. The dye may have one anionic or acid group, selected from the list consisting of—$CO_2H$, —$CONHSO_2R^h$, —$SO_2NHCOR^i$, —$SO_2NHSO_2R^j$, —$PO_3H_2$, —$OPO_3H_2$, —$OSO_3H$, —S—$SO_3H$ or —$SO_3H$ groups or their corresponding salts, wherein $R^h$, $R^i$ and $R^j$ are independently an aryl or an alkyl group, preferably a methyl group, and wherein the salts are preferably alkali metal salts or ammonium salts, including mono- or di- or tri- or tetra-alkyl ammonium salts.

The IR-dye is preferably presented by one of the following Formulae B, C, D, E or F:

Formula B

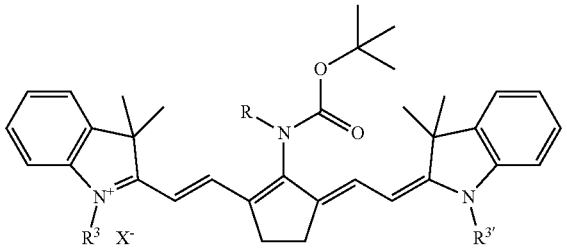

Formula C

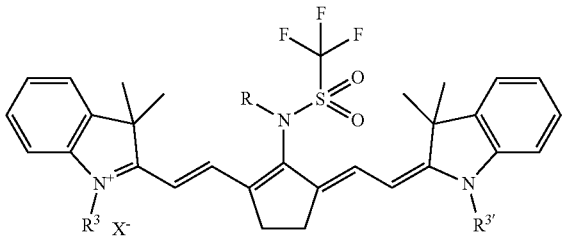

-continued

Formula D

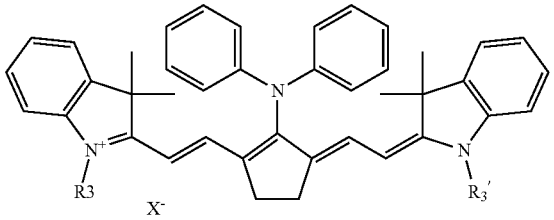

wherein $X^-$ represents halogen, sulphonate, perfluorosulphonate, tosylate, tetrafluoroborate, hexafluorophosphate, arylborate or arylsulphonate; and $R^3$, $R^{3'}$ independently represent an optionally substituted alkyl group, preferably a methyl or ethyl; or an ether group, preferably —$CH_2$—$CH_2$—O—$CH_3$.

Formula E

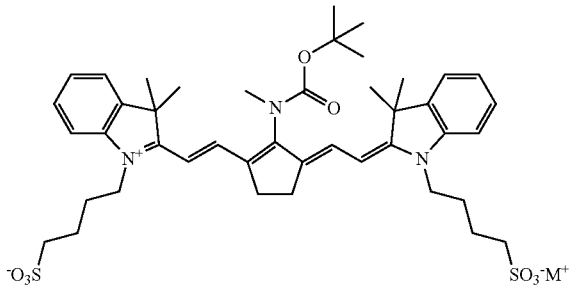

Formula F

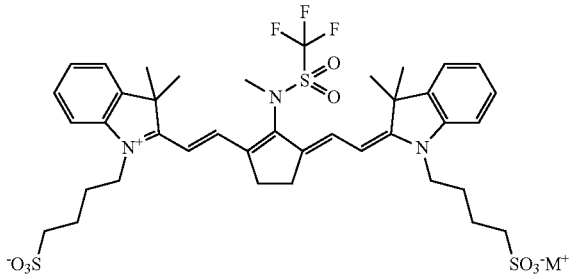

wherein $M^+$=$Li^+$, $Na^+$, $K^+$, $NH_4^+$, R'R"R'"$NH^+$ wherein R', R", R'" are independently a H atom, an optional substituted alkyl or aryl group.

Other Ingredients

Optionally, the coating may further contain additional ingredients. These ingredients may be present in the image-recording layer or in an optional other layer. For example, binders, polymer particles such as matting agents and spacers, surfactants such as perfluoro surfactants, silicon or titanium dioxide particles, development inhibitors, development accelerators or colorants are suitable components for the coating. Preferably the coating includes a printing-out agent, i.e. a compound which is capable of changing the color of the coating upon exposure. After image-wise exposing the precursor, a visible image can be produced, also referred to as "print-out image". The printing-out agent may be a compound as described in EP-A-1 491 356 paragraph [0116] to [0119] on page 19 and 20, and in US 2005/008971 paragraph [0168] to [0172] on page 17. Preferred printing-out agents are the compounds described in EP 1 765 592 from line 1 page 9 to line 27 page 20. More preferred are the IR-dyes as described in EP 1 736 312 from line 32 page 5 to line 9 page 32. The contrast of the image formed after image-wise exposure and processing enables the end-user to establish immediately whether or not the precursor has already been exposed and processed, to distinguish the different color selections and to inspect the quality of the image on the plate precursor. In order to obtain a good visual contrast for a human observer the type of color of the colorant may also be important. Preferred colors for the colorant are cyan or blue colors, i.e. under blue color we understand a color that appears blue for the human eye.

Preferably the coating, preferably the image-recording layer, includes a hydrophilic binder such as homopolymers and copolymers of vinyl alcohol, acrylamide, methylol acrylamide, methylol methacrylamide, acrylic acid, methacrylic acid, hydroxyethyl acrylate, hydroxyethyl methacrylate and maleic anhydride/vinylmethylether copolymers.

The imaging layer has a coating thickness preferably ranging between 0.4 and 5.0 g/$m^2$, more preferably between 0.5 and 3.0 g/$m^2$, most preferably between 0.6 and 2.2 g/$m^2$.

The lithographic printing precursors can be multi-layer imageable elements; for example the coating may contain additional layer(s) such as for example an adhesion-improving layer located between the imaging layer and the support.

The Lithographic Printing Plate Precursor

The lithographic printing plate precursor according to the present invention is negative-working, i.e. after exposure and development the non-exposed areas of the coating are removed from the support and define hydrophilic (non-printing) areas, whereas the exposed coating is not removed from the support and defines oleophilic (printing) areas. The hydrophilic areas are defined by the support which has a hydrophilic surface or is provided with a hydrophilic layer. Areas having hydrophilic properties means areas having a higher affinity for an aqueous solution than for an oleophilic ink; areas having hydrophobic properties means areas having a higher affinity for an oleophilic ink than for an aqueous solution.

Support

The lithographic printing plate used in the present invention comprises a support which has a hydrophilic surface or which is provided with a hydrophilic layer. The support is preferably a grained and anodized aluminium support, well known in the art. Suitable supports are for example disclosed in EP 1 843 203 (paragraphs [0066] to [0075]). The surface roughness, obtained after the graining step, is often expressed as arithmetical mean center-line roughness Ra (ISO 4287/1 or DIN 4762) and may vary between 0.05 and 1.5 μm. The aluminum substrate of the current invention has preferably an Ra value below 0.45 μm, more preferably below 0.40 μm and most preferably below 0.30 μm. The lower limit of the Ra value is preferably about 0.1 μm. More details concerning the preferred Ra values of the surface of the grained and anodized aluminum support are described in EP 1 356 926. By anodising the aluminum support, an $Al_2O_3$ layer is formed and the anodic weight (g/$m^2$ $Al_2O_3$ formed on the aluminum surface) varies between 1 and 8 g/$m^2$. The anodic weight is preferably ≥3 g/$m^2$, more preferably ≥3.5 g/$m^2$ and most preferably ≥4.0 g/$m^2$.

The grained and anodized aluminium support may be subjected to so-called post-anodic treatments, for example a treatment with polyvinylphosphonic acid or derivatives thereof, a treatment with polyacrylic acid, a treatment with potassium fluorozirconate or a phosphate, a treatment with an alkali metal silicate, or combinations thereof. However, for a precursor optimized to be used without a pre-heat step it is preferred to use a grained and anodized aluminium support without any post-anodic treatment.

Alternatively, the support may be treated with an adhesion promoting compound which may improve the adhesion between the coating and the support and the durability of the plate in the printing process. They typically have an ethylenically unsaturated bond and a functional group capable of adsorbing to the surface of the support, for example a phosphate group, a phosphonate group and a trialkoxysilane group. The compound can be present in the photopolymerisble layer or in an intermediate layer between the support and the photopolymerisable layer. Suitable examples thereof are disclosed in EP 1 788 434 in [0010], WO 2013/182328, EP 851 299, EP 1 091 251, US 2004/214105, EP 1 491 356, US 2005/39620, EP 1 495 866, EP 1 500 498, EP 1 520 694 and EP 1 557 262, EP 2 212 746 and EP 2007/059379.

Besides an aluminium support, a plastic support, for example a polyester support, provided with one or more hydrophilic layers as disclosed in for example EP 1 025 992 may also be used.

Method for Making a Lithographic Printing Plate Precursor

According to the present invention there is also provided a method for making a negative-working lithographic printing plate comprising the steps of imagewise exposing the printing plate precursor of the present invention followed by developing the imagewise exposed precursor so that the non-exposed areas are dissolved in the developer solution.

The lithographic printing plate precursor can be prepared by (i) applying on a support as described above the coating as described above and (ii) drying the precursor.

It is believed that, upon heating and/or imaging with an IR laser whereby the IR-dye for example encapsulated within the vinylogous vitrimer particles—preferably the vitrimer polyurethane particles—absorbs the light and emits heat energy, the released heat enables the permanent crosslinked vinylogous vitrimer particles to display thermoplastic behaviour through the dynamic nature of the covalent adaptable network (CAN) whereby the particles become molten, and form a continuous layer. In other words, the vinylogous vitrimer particles become fused and thus a crosslinked, fused layer is formed. Once cooled down, the dynamic cross-links are again frozen and the material exhibits again thermosetting behaviour. In all stages, the material remains a cross-linked network. As a result, the non-exposed areas containing the non-fused vinylogous vitrimer particles are capable of being developed.

Exposure Step

The printing plate precursor can be directly exposure to heat, e.g. by means of a thermal head, or by the light absorption of one or more compounds in the coating that are capable of converting light, more preferably infrared light, into heat. Preferably, the printing plate precursor is image-wise exposed by a laser emitting IR-light. Preferably, the image-wise exposing step is carried out off-press in a platesetter, i.e. an exposure apparatus suitable for image-wise exposing the precursor with a laser such as a laser diode, emitting around 830 nm, a Nd YAG laser, emitting around 1060 nm, or by a conventional exposure in contact with a mask. In a preferred embodiment of the present invention, the precursor is image-wise exposed by a laser emitting IR-light.

The printing plate of the present invention is characterized that it can be exposed at a low energy density, i.e. below 190 $mJ/m^2$; preferably between 70 $mJ/m^2$ and 180 $mJ/m^2$; more preferably between 80 $mJ/m^2$ and 150 $mJ/m^2$ and most preferably between 90 $mJ/m^2$ and 120 $mJ/m^2$.

Development Step

During the development step, the non-exposed areas of the coating are at least partially removed without essentially removing the exposed areas. The processing liquid, also referred to as developer, can be applied to the plate e.g. by rubbing with an impregnated pad, by dipping, immersing, coating, spincoating, spraying, pouring-on, either by hand or in an automatic processing apparatus. The treatment with a processing liquid may be combined with mechanical rubbing, e.g. by a rotating brush. During the development step, any water-soluble protective layer present is preferably also removed. The development is preferably carried out at temperatures between 20 and 40° C. in automated processing units.

The use of automatic development apparatus is well known in the art and generally includes pumping processing liquid into a developing tank or ejecting it from spray nozzles. The development apparatus can include a rinsing tank for rinsing the printing plate precursor after development and a gum tank for applying a gum capable of protecting the lithographic image on the printing plate against contamination or damage (for example, from oxidation, fingerprints, dust, or scratches). The processing unit may also include a suitable rubbing mechanism (for example a brush or roller) and a suitable number of conveyance rollers. For example, the processing liquid can be applied to the imaged element by rubbing, spraying, jetting, dipping, immersing, slot die coating (for example see FIGS. 1 and 2 of U.S. Pat. No. 6,478,483), reverse roll coating (as described in FIG. 4 of U.S. Pat. No. 5,887,214), contacting it with a roller, impregnated pad, or applicator containing the processing liquid. For example the imaged printing plate precursor can be brushed with the processing liquid, or it can be poured onto or applied by spraying the imaged surface with sufficient force to remove the non-printing areas of the radiation sensitive layer using a spray nozzle system as described for example in [0124] of EP 1 788 431 and U.S. Pat. No. 6,992,688.

In a highly preferred embodiment, the development step as described above is replaced by an on-press processing whereby the imaged precursor is mounted on a press and processed on-press by rotating said plate cylinder while feeding dampening liquid and/or ink to the coating of the precursor to remove the unexposed areas from the support. In a preferred embodiment, only dampening liquid is supplied to the plate during start-up of the press. After a number of revolutions of the plate cylinder, preferably less than 50 and most preferably less than 5 revolutions, also the ink supply is switched on. In an alternative embodiment, supply of dampening liquid and ink can be started simultaneously or only ink can be supplied during a number of revolutions before switching on the supply of dampening liquid.

The processing step may also be performed by combining embodiments described above, e.g. combining development with a processing liquid with development on-press by applying ink and/or fountain.

Developer

The developer may be an alkaline developer or solvent-based developer. Suitable alkaline developers have been described in for example US2005/0162505. An alkaline developer is an aqueous solution which has a pH of at least 11, more typically at least 12, preferably from 12 to 14. Alkaline developers typically contain alkaline agents to obtain high pH values can be inorganic or organic alkaline agents. The developers can comprise anionic, non-ionic and amphoteric surfactants (up to 3% on the total composition weight); biocides (antimicrobial and/or antifungal agents), antifoaming agents or chelating agents (such as alkali gluconates), and thickening agents (water soluble or water dispersible polyhydroxy compounds such as glycerine or polyethylene glycol).

Preferably, the processing liquid is a gum solution whereby during the development step the non-exposed areas are removed from the support and the plate is gummed in a single step. The development with a gum solution has the additional benefit that, due to the remaining gum on the plate in the non-exposed areas, an additional gumming step is not required to protect the surface of the support in the non-printing areas. As a result, the precursor is processed and gummed in one single step which involves a less complex developing apparatus than a developing apparatus comprising a developer tank, a rinsing section and a gumming section. The gumming section may comprise at least one gumming unit or may comprise two or more gumming units. These gumming units may have the configuration of a cascade system, i.e. the gum solution, used in the second gumming unit and present in the second tank, overflows from the second tank to the first tank when gum replenishing solution is added in the second gumming unit or when the gum solution in the second gumming unit is used once-only, i.e. only starting gum solution is used to develop the precursor in this second gumming unit by preferably a spraying or jetting technique. More details concerning such gum development is described in EP1 788 444.

A gum solution is typically an aqueous liquid which comprises one or more surface protective compounds that are capable of protecting the lithographic image of a printing plate against contamination, e.g. by oxidation, fingerprints, fats, oils or dust, or damaging, e.g. by scratches during handling of the plate. Suitable examples of such surface protective compounds are film-forming hydrophilic polymers or surfactants. The layer that remains on the plate after treatment with the gum solution preferably comprises between 0.005 and 20 g/m$^2$ of the surface protective compound, more preferably between 0.010 and 10 g/m$^2$, most preferably between 0.020 and 5 g/m$^2$. More details concerning the surface protective compounds in the gum solution can be found in WO 2007/057348 page 9 line 3 to page 11 line 6. As the developed plate precursor is developed and gummed in one step, there is no need to post-treat the processed plate.

The gum solution preferably has a pH value between 3 and 11, more preferably between 4 and 10, even more preferably between 5 and 9, and most preferably between 6 and 8. A suitable gum solution is described in for example EP 1 342 568 in [0008] to [0022] and WO2005/111727. The gum solution may further comprise an inorganic salt, an anionic surfactant, a wetting agent, a chelate compound, an antiseptic compound, an antifoaming compound and/or an ink receptivity agent and/or combinations thereof. More details about these additional ingredients are described in WO 2007/057348 page 11 line 22 to page 14 line 19.

Drying

After the processing step the plate may be dried in a drying unit. In a preferred embodiment the plate is dried by heating the plate in the drying unit which may contain at least one heating element selected from an IR-lamp, an UV-lamp, a heated metal roller or heated air. In a preferred embodiment of the present invention, the plate is dried with heated air as known in the drying section of a classical developing machine.

Heating

After drying the plate, the plate can optionally be heated in a baking unit. More details concerning the heating in a baking unit can be found in WO 2007/057348 page 44 line 26 to page 45 line 20. During the baking step, the plate is heated up to a baking temperature which is higher than the vitrimer transition temperature $T_v$. A preferred baking temperature is above 50° C., more preferably above 100° C. 'Baking temperature' as used herein refers to the temperature of the plate during the baking process. In a preferred embodiment, the baking temperature does not exceed 300° C. during the baking period. More preferably, the baking temperature does not exceed 250° C., even not 220° C. Baking can be done in conventional hot air ovens or by irradiation with lamps emitting infrared light as disclosed in EP-A 1 506 854.

The printing plate thus obtained can be used for conventional, so-called wet offset printing, in which ink and an aqueous dampening liquid is supplied to the plate. Another suitable printing method uses a so-called single-fluid ink without a dampening liquid. Suitable single-fluid inks have been described in U.S. Pat. Nos. 4,045,232; 4,981,517 and 6,140,392. In a most preferred embodiment, the single-fluid ink comprises an ink phase, also called the hydrophobic or oleophilic phase, and a polyol phase as described in WO 00/32705.

EXAMPLES

All materials used were readily available from standard sources such as Sigma-Aldrich (Belgium) and Acros (Belgium) unless otherwise specified.

1. Preparation of the Printing Plate Precursors Preparation of the Aluminium Support S-01

A 0.3 mm thick aluminium foil was degreased by spraying with an aqueous solution containing 26 g/l NaOH at 65° C. for 2 seconds and rinsed with demineralised water for 1.5 seconds. The foil was then electrochemically grained during 10 seconds using an alternating current in an aqueous solution containing 15 g/l HCl, 15 g/l $SO_4^{2-}$ ions and 5 g/l $Al^{3+}$ ions at a temperature of 37° C. and a current density of about 100 A/dm$^2$. Afterwards, the aluminium foil was then desmutted by etching with an aqueous solution containing 5.5 g/l of NaOH at 36° C. for 2 seconds and rinsed with demineralised water for 2 seconds. The foil was subsequently subjected to anodic oxidation during 15 seconds in an aqueous solution containing 145 g/l of sulfuric acid at a temperature of 50° C. and a current density of 17 A/dm$^2$, then washed with demineralised water for 11 seconds and post-treated for 3 seconds by spraying a solution of 1.1 g/L of polyvinylphosphonic acid at 70° C., rinsed with demineralized water for 1 second dried at 120° C. for 5 seconds.

The support thus obtained was characterized by a surface roughness Ra of 0.35-0.4 μm (measured with interferometer NT1100) and had an oxide weight of 3.0 g/m$^2$.

Preparation of the Aluminium Support S-02

The preparation of support S-02 is carried out in the same way as described for support S-01 except that no polyvinyl phosphonic acid layer is applied.

Synthesis of Acetoacetate Monomer (AcAc)

The bisacetoacetate monomer, further referred to as AcAc, according to Formula 1 is prepared as follows:

Formula 1

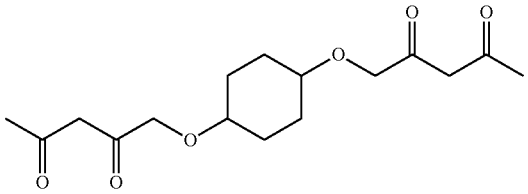

0.2 mol of 1,4 cyclohexanedimethanol (commercially available from Eastman) was melted at 70° C. and transferred to a reaction vessel together with 0.4 mol of tertiar butyl acetoacetate. To this, 40 ml of xylene was added and the reaction mixture was brought to a temperature of 135° C. for 2 hours, after which the reaction mixture was cooled. Next, xylene was evaporated using a rotavapor operating at 80° C. and 60 mbar. The product was subsequently crystallized with the addition of 100 ml isopropanol and heating to 70° C. The precipitate was finally isolated by filtration.

Preparation the Vinylogous Polyurethane Dispersion DISP-01

The ingredients for the preparation of DISP 1 are summarized in Table 1 below.

In a first reaction vessel (A) 6.68 g AcAc was dissolved in 35 g dichloromethane at room temperature, followed by the addition of 0.26 g IR dye S2025 (commercially available from FEW chemicals) and 1.37 g AGNIQUE AAM 181D-F (commercially available from Cognis). In a second reaction vessel (B), 1.41 g xylenediamine (commercially available from Acros), 1.01 g tris(2-aminoethyl)amine (commercially available from Aldrich) and 89.26 g distilled water were added and mixed at room temperature using an Ultraturrax™ mixer (15000 rpm), while the content of reaction vessel A was added. The mixture was allowed to mix under cooling in an ice bath for 5 minutes, after which the dispersion was transferred to an evaporation vessel. The dichloromethane solvent was distilled at 50° C. and 150 mbar at a rotavapor to isolate the vinylogous polyurethane particles. Particle size was evaluated using dynamic light scattering. Particle size was measured with a Malvern Zetasizer Nano ZS' commercially available from Malvern, at 22° C. after a stabilization time of 2 minutes.

Preparation of the Vinylogous Polyurethane Dispersion DISP-02

The vinylogous polyurethane dispersion DISP-02 was prepared as described above for DISP-01 using the ingredients as summarized in Table 1 below.

TABLE 1

Ingredients of DISP-01 and DISP-02

| Ingredients | DISP-01 | DISP-02 |
|---|---|---|
| Reaction vessel A | | |
| AcAc (1) | 6.68 g | 6.68 g |
| IR-01 (2) | 0.26 g | 0.52 g |
| $CH_2Cl_2$ | 35 g | 35 g |
| Agnique AAM 181D-F (3) | 1.37 g | 1.37 g |

TABLE 1-continued

Ingredients of DISP-01 and DISP-02

| Ingredients | DISP-01 | DISP-02 |
|---|---|---|
| Reaction vessel B | | |
| Xylenediamine | 1.41 g | 1.41 g |
| Tris(2-aminoethyl)amine | 1.01 g | 1.01 g |
| Distilled $H_2O$ | 89.26 g | 89.00 g |
| Total wt. % (in $H_2O$) | 10.74 | 11.00 |
| Z-average particle size (nm) (4) | 331 | 388 |

(1) bisacetoacetate monomer, synthesis see above;

(2) IR-01 is an infrared absorbing dye commercially available from FEW Chemicals having the following structure:

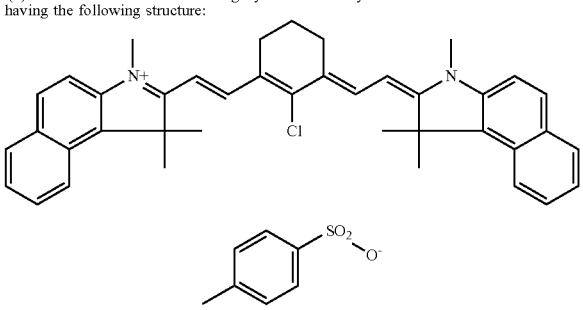

(3) Surfactant commercially available from Cognis;

(4) Particle size was measured with a Malvern Zetasizer Nano ZS, commercially available from Malvern, at 22° C. after a stabilization time of 2 minutes.

Preparation of the Coating Solutions CS-01 and CS-02

The coating solutions CS-01 and CS-02 were prepared by diluting the above described dispersions DISP-01 and DISP-02 with distilled water according to Table 2.

TABLE 2 coating solutions CS-01 and CS-02

| Components | Coating solutions | |
|---|---|---|
| g | CS-01 | CS-02 |
| DISP-01 | 1.6 | — |
| DISP-02 | — | 0.8 |
| $H_2O$ | 1.7 | 2.5 |

Preparation of the Printing Plate Precursors PPP-01 to PPP-10

The printing plate precursor PPP-01 to PPP-10 were prepared by coating onto the above described supports S-01 and S-02 the components as defined in Table 3. Coating thickness and drying temperature are summarized in Table 3 below.

TABLE 3

Printing plate precursors PPP-01 to PPP-10

| Printing plate precursor | Support | Coating solution | Coating thickness μm | Drying Temp. ° C. |
|---|---|---|---|---|
| PPP-01 | S-01 | CS-01 | 30 | 50 |
| PPP-02 | S-01 | CS-02 | 30 | 50 |
| PPP-03 | S-02 | CS-01 | 30 | 50 |
| PPP-04 | S-02 | CS-02 | 30 | 50 |
| PPP-05 | S-01 | CS-01 | 50 | 50 |
| PPP-06 | S-02 | CS-01 | 50 | 50 |
| PPP-07 | S-01 | CS-02 | 50 | 50 |
| PPP-08 | S-02 | CS-02 | 50 | 50 |
| PPP-09 | S-02 | CS-02 | 30 | 100 |
| PPP-10 | S-02 | CS-02 | 50 | 100 |

Exposure

PPP-1 to PPP-10 were imaged at 2400 dpi with a High Power Creo 40W TE38 thermal platesetter (200 lpi Agfa Balanced Screening (ABS)), commercially available from Kodak and equipped with a 830 nm IR laser diode, at an energy densities of between 100 and 250 mJ/cm$^2$. All samples displayed a visual print-out image.

Development

After the imaging step, the non-image parts were removed by gentle whipping with a cotton pad soaked with a 2% Prima FS404 (Trademark of Agfa Graphics) in distilled water. Printing plates PP-01 to PP-10 were obtained.

1. Clean-Out and Image Strength Evaluation Clean-out

The level of removal of the non-image parts (clean-out) of the obtained printing plates PP-01 to PP-08 was subsequently visually evaluated and scored as follows:

0: non-image part difficult to be removed

1: non-image part partially removed

2: non-image part completely removed

Image Strength

The image strength of the obtained printing plates PP-01 to PP-08, which relates to the adhesion of the image parts to the support, was also evaluated. The level of removal of the image parts due to the whipping with the cotton pad was scored as follows:

0: image part is completely removed

1: image part is partially removed

2: image part is not removed

The results of the clean-out and image strength evaluation are summarized in Table 4 below.

TABLE 4

Clean-out and image strength of printing plates PP-01 to PP-08

| Printing plate | Coating solution* | Coating thickness* µm | Support* | Clean-out** (Non-image removal) | Image strength** @ 200 mJ/cm2 |
|---|---|---|---|---|---|
| PP-01 | CS-01 | 30 | S-01 | 2 | 1 |
| PP-02 | CS-02 | 30 | S-01 | 2 | 1 |
| PP-03 | CS-01 | 30 | S-02 | 2 | 2 |
| PP-04 | CS-02 | 30 | S-02 | 2 | 2 |
| PP-05 | CS-01 | 50 | S-01 | 2 | 2 |
| PP-06 | CS-01 | 50 | S-02 | 2 | 2 |
| PP-07 | CS-02 | 50 | S-01 | 2 | 2 |
| PP-08 | CS-02 | 50 | S-02 | 2 | 2 |

*See above;

**Scores as defined above.

The result in Table 4 show that the printing plates including the vinylogous vitrimer particles show both a good clean out behavior and image-strength. Furthermore, the result show that at the lower coating thickness (30 µm), the image strength is influenced by the substrate preparation (see PP-01 versus PP-03 and PP-02 versus PP-04): the obtained image strength results are better for the printing plates including the supports which were not post treated with PVA (i.e. support S-02) compared to image strength results for the printing plates including the supports which were post treated with PVA (i.e. support S-01).

1. Abrasion Resistance

The abrasion resistance of the printing plates PP-09 and PP-10 was tested as follows:

The coating of each plate was wetted at six areas, by applying 4 ml of demineralised water at each area, so as to obtain six distinct wetted areas having a diameter of about 40 mm each.

A round rubber (hardness 65 Shore A) stamp with a diameter of 15 mm was placed on each wet area. The rubber stamps were then rotated at a speed of 100 rpm, while maintaining contact between the stamp and the coating at a load of 9.5 N per stamp during a number of test cycles. Each test cycle consists of 10 seconds of contact between the rotating stamp and the coating, followed by 1 second of non-contact in order to allow the water to spread again on the contact area.

After conclusion of the test cycles, the wear of the coating was evaluated by visual inspection:

a score of 0 was given to a contact area without any visible damage of the coating;

a score of 1 was given to a contact area where a colour change was visible; and a score of 2 was given to a contact area where a grey colour from the aluminium or aluminium oxide was visible.

The sum of the scores obtained from the abrasion evaluation on the 6 contact areas of each printing plate is given in Table 5.

TABLE 5 abrasion test

| | Abrasian resistance score (1) Number of cycles | | | |
|---|---|---|---|---|
| Printing plate | 150 | 300 | 500 | 1000 |
| PP-09 | 0 | 3 | 6 | 12 |
| PP-10 | 0 | 0 | 0 | 1 |

(1) Score is defined above

The above results show that the printing plate including the vinylogous vitrimer particles provides an excellent abrasion resistance to the printing plates. At the higher number of cycles, i.e. above 150, the abrasion resistance of the coating can be further improved by increasing the layer thickness as shown by the difference in abrasion resistance between printing plates PP-09 and PP-10.

The invention claimed is:

1. A negative-working lithographic printing plate precursor comprising:

a support; and a coating provided on the support and including vinylogous vitrimer particles including a resin having at least one moiety having Formula (I), (II), and/or (Ill):

Formula (I)

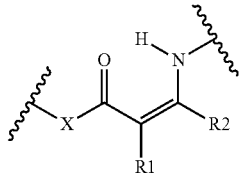

Formula (II)

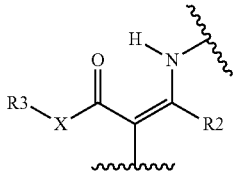

-continued

Formula (III)

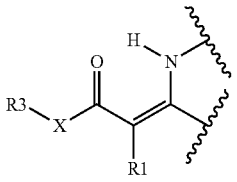

wherein

R1 represents hydrogen; an optionally substituted alkyl, cycloalkyl, alkenyl, cycloalkenyl, alkynyl, aralkyl, alkaryl, aryl, or heteroaryl group; COR4; or CN;

R2 represents hydrogen; an optionally substituted alkyl, cycloalkyl, alkenyl, cycloalkenyl, alkynyl, aralkyl, alkaryl, aryl, or heteroaryl group; or COR4;

R1 and R2 may represent atoms necessary to form a five to eight membered ring;

R3 represents an optionally substituted alkyl, cycloalkyl, alkenyl, cycloalkenyl, alkynyl, aralkyl, alkaryl, aryl, or heteroaryl group;

R4 represents hydrogen; an optionally substituted alkyl, cycloalkyl, alkenyl, cycloalkenyl, alkynyl, aralkyl, alkaryl, aryl, or heteroaryl group; OR5; or NR6R7;

R5 represents an optionally substituted alkyl, cycloalkyl, alkenyl, cycloalkenyl, alkynyl, aralkyl, alkaryl, aryl, or heteroaryl group;

R6 and R7 independently represent hydrogen; an optionally substituted alkyl, cycloalkyl, alkenyl, cycloalkenyl, alkynyl, aralkyl, alkaryl, aryl, or heteroaryl group; or R6 and R7 may represent atoms necessary to form a five to eight membered ring;

X represents O , NR8, or CR9R10;

R8, R9, and R10 independently represent hydrogen; or an optionally substituted alkyl, cycloalkyl, alkenyl, cycloalkenyl, alkynyl, aralkyl, alkaryl, aryl, or heteroaryl group;

R8 and R3 may represent atoms necessary to form a five to eight membered ring; and any of R3, R9, and R10 may represent atoms necessary to form a five to eight membered ring.

2. The printing plate precursor according to claim 1, wherein X represents O.

3. The printing plate precursor according to claim 1, wherein the resin has a moiety according to Formula I.

4. The printing plate precursor according to claim 1, wherein R1 and R2 independently represent hydrogen or an optionally substituted alkyl, aryl, or heteroaryl group.

5. The printing plate precursor according to claim 1, wherein the vinylogous vitrimer particles include a core and shell structure in which the shell includes the resin.

6. The printing plate precursor according to claim 5, wherein the coating further includes an infrared absorbing dye.

7. The printing plate precursor according to claim 6, wherein the infrared absorbing dye is provided in the core of the vinylogous vitrimer particles.

8. The printing plate precursor according to claim 6, wherein the infrared absorbing dye is represented by Formula (A):

Formual A

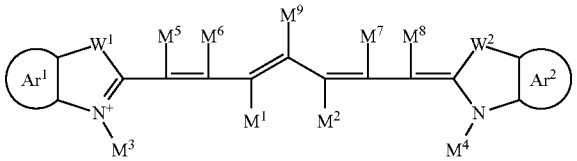

wherein $Ar^1$ and $Ar^2$ are independently an optionally substituted aromatic hydrocarbon group or an aromatic hydrocarbon group including an annulated benzene ring that is optionally substituted;

$W^1$ and $W^2$ are independently a sulphur atom or a —$CM^{10}M^{11}$ group in which $M^{10}$ and $M^{11}$ are independently an optionally substituted aliphatic hydrocarbon group or an optionally substituted (hetero)aryl group, or in which $M^{10}$ and $M^{11}$ together include atoms necessary to form a cyclic structure;

$M^1$ and $M^2$ together include atoms necessary to form an optionally substituted cyclic structure;

$M^3$ and $M^4$ independently represent an optionally substituted aliphatic hydrocarbon group;

$M^5$, $M^6$, $M^7$, and $M^8$ independently represent hydrogen, a halogen, or an optionally substituted aliphatic hydrocarbon group;

$M^9$ represents a halogen, an optionally substituted aliphatic hydrocarbon group, an optionally substituted (hetero)aryl group, —$NR^1R^2$, —$NR^1$—CO—$R^6$, —$NR^1$—S02-$R^4$, or —$NR^1$—SO—$R^5$;

$R^1$ and $R^2$ independently represent hydrogen, an optionally substituted aliphatic hydrocarbon group, or an optionally substituted (hetero)aryl group;

$R^4$ and $R^6$ independently represent $0R^7$, —$NR^8R^9$, or —$CF_3$;

$R^7$ represents an optionally substituted (hetero)aryl group or an optionally branched aliphatic hydrocarbon group;

$R^8$ and $R^9$ independently represent hydrogen, an optionally substituted aliphatic hydrocarbon group, or an optionally substituted (hetero)aryl group, or in which $R^8$ and $R^9$ together include atoms necessary to form a cyclic structure;

$R^5$ represents hydrogen, an optionally substituted aliphatic hydrocarbon group, $SO_3^-$, —$COOR^{10}$, or an optionally substituted (hetero)aryl group, in which $R^{10}$ represents an optionally substituted (hetero)aryl group or an aliphatic hydrocarbon group; and the infrared absorbing dye may include one or more counter ions to obtain an electrically neutral molecule.

9. The printing plate precursor according to claim 1, wherein the coating further includes a compound capable of generating a visual print-out image.

10. A method for making a printing plate comprising;

image-wise exposing the printing plate precursor as defined in claim 1 to heat and/or IR radiation; and developing the exposed printing plate precursor.

11. The method according to claim 10, wherein the step of developing is performed off-press and includes treating the exposed printing plate precursor with a developing solution to remove non-exposed areas of the coating from the support.

12. The method according to claim 11, wherein the developing solution includes water, or a gum solution that develops and gums the exposed printing plate precursor in one single step.

13. The method according to claim 10, wherein the step of developing is performed on-press and includes mounting the exposed printing plate precursor on a plate cylinder of a lithographic printing press and rotating the plate cylinder while supplying dampening liquid and/or ink to the coating.

14. The method according to claim 10, wherein the IR radiation has an energy density between 70 $mJ/m^2$ and 180 $mJ/m^2$.

* * * * *